US006333454B1

(12) United States Patent
Griffiths

(10) Patent No.: US 6,333,454 B1
(45) Date of Patent: Dec. 25, 2001

(54) ACOUSTIC SUPPORT STRUCTURE FOR STRINGED MUSICAL INSTRUMENTS AND METHOD OF MAKING SAME

(75) Inventor: Chris Griffiths, St. John's (CA)

(73) Assignee: Griffiths Guitar International Ltd. (CA)

( * ) Notice: Subject to any disclaimer, the term of this patent is extended or adjusted under 35 U.S.C. 154(b) by 0 days.

(21) Appl. No.: 09/492,809

(22) Filed: Jan. 28, 2000

(51) Int. Cl.[7] ..... G10D 3/00
(52) U.S. Cl. ..... 84/291; 84/290
(58) Field of Search ..... 84/267, 290, 291

(56) References Cited

U.S. PATENT DOCUMENTS

| | | | | |
|---|---|---|---|---|
| 1,768,261 | * | 6/1930 | Larson | 84/267 |
| 3,685,385 | * | 8/1972 | Rendell | 84/267 |
| 3,892,159 | * | 7/1975 | Houtsma | 84/307 |
| 4,079,654 | * | 3/1978 | Kasha | 84/291 |
| 4,084,475 | | 4/1978 | Horowitz . | |
| 4,178,827 | | 12/1979 | Mallory . | |
| 4,213,370 | | 7/1980 | Jones . | |
| 4,291,606 | * | 9/1981 | Lepage | 84/291 |
| 4,429,608 | | 2/1984 | Kaman et al. . | |
| 4,836,076 | | 6/1989 | Bernier . | |
| 4,881,441 | | 11/1989 | Larsen . | |
| 5,396,823 | | 3/1995 | Hoshino . | |
| 5,406,874 | * | 4/1995 | Witchel | 84/291 |
| 5,467,770 | | 11/1995 | Taylor . | |
| 5,469,770 | * | 11/1995 | Taylor | 84/291 |
| 5,945,614 | * | 8/1999 | White | 84/267 |

FOREIGN PATENT DOCUMENTS

| | | |
|---|---|---|
| 0169155 A | 1/1986 | (EP) . |
| 2563361 A | 10/1985 | (FR) . |

* cited by examiner

*Primary Examiner*—Robert E. Nappi
*Assistant Examiner*—Kim Lockett
(74) *Attorney, Agent, or Firm*—Dinesh Agarwal, P.C.

(57) ABSTRACT

A stringed musical instrument including a soundbox. The soundbox has a back, a side adjoining the back to define a hollow interior, a soundboard covering the hollow interior, and a soundboard support structure including a plurality of kerfing members for securing the soundboard on the side opposite the back to cover the hollow interior and a plurality of bracing members for reinforcing the soundboard. The soundboard support structure includes a plurality of adjoining members selected from the group consisting of the plurality of kerfing members and the plurality of bracing members. The plurality of adjoining members are integrally formed as a single piece of polyurethane containing a plurality of half inch glass fibres.

18 Claims, 8 Drawing Sheets

ACOUSTIC SUPPORT STRUCTURE FOR STRINGED MUSICAL INSTRUMENTS AND METHOD OF MAKING SAME

FIELD OF THE INVENTION

The invention relates in general to stringed musical instruments, and more particularly to an acoustic support structure for stringed musical instruments.

BACKGROUND OF THE INVENTION

The manufacture of wooden musical instruments by conventional methods is both expensive and time-consuming. Typically, wooden musical instruments are made of many different components which must be first manufactured and then assembled by skilled workers, thereby increasing manufacturing expense.

Prior art stringed musical instruments have been devised to address these problems. For example, U.S. Pat. No. 5,396,823 (Hoshino) discloses a guitar that is made largely of plastic. A typical guitar would include a soundbox, and a neck extending therefrom to a head. The soundbox includes a wooden side, an adjoining wooden back portion, and a wooden soundboard on top of the side opposite to the back portion. In Hoshino, the side and back portion are integrally formed of plastic as a single piece. This considerably reduces manufacturing time and expense. However, the resulting guitar may suffer in terms of both its appearance and acoustic properties.

Accordingly, a stringed musical instrument that retains the desirable acoustic characteristics resulting from a wooden construction, but is less expensive and time-consuming to manufacture, is desirable.

SUMMARY OF THE INVENTION

An object of one aspect of the present invention is to provide an improved stringed musical instrument.

In accordance with this aspect of the present invention, there is provided a stringed musical instrument comprising a soundbox. The soundbox has a back, a side adjoining the back to define a hollow interior, a soundboard covering the hollow interior, and a soundboard support structure including a plurality of kerfing members for securing the soundboard on the side opposite the back to cover the hollow interior, and a plurality of bracing members for reinforcing the soundboard. The soundboard support structure includes a plurality of adjoining members selected from the group consisting of the plurality of kerfing members and the plurality of bracing members. The plurality of adjoining members are integrally formed as a single piece of hardenable plastic material.

In accordance with another aspect of the present invention, there is provided an improved method of manufacturing a stringed musical instrument having a sound box. The soundbox has a back, a side adjoining the back to define a hollow interior, and a soundboard covering the hollow interior. The method comprises forming a soundboard support structure for supporting the soundboard on the soundbox. The soundboard support structure includes a plurality of kerfing members for securing the soundboard on the side opposite the back to cover the hollow interior, a plurality of bracing members for reinforcing the soundboard, and a plurality of adjoining members selected from the group consisting of the plurality of kerfing members and the plurality of bracing members, the plurality of adjoining members being formed as a single piece of a hardenable plastic material. The method further comprises the steps of shaping the back, the side and the soundboard of the soundbox to substantially conform to a dimension of the single piece of a hardenable plastic material, securing the soundboard on the side using the soundboard support structure, and securing the back on the side opposite the soundboard.

Preferably, the hardenable plastic material is a thermoplastic polymer. Preferably, this thermoplastic polymer is polyurethane containing a plurality of half inch glass fibres.

BRIEF DESCRIPTION OF THE DRAWINGS

A detailed description of the preferred embodiments is provided herein below with reference to the following drawings, in which.

DETAILED DESCRIPTION OF PREFERRED EMBODIMENTS

Figure 1:
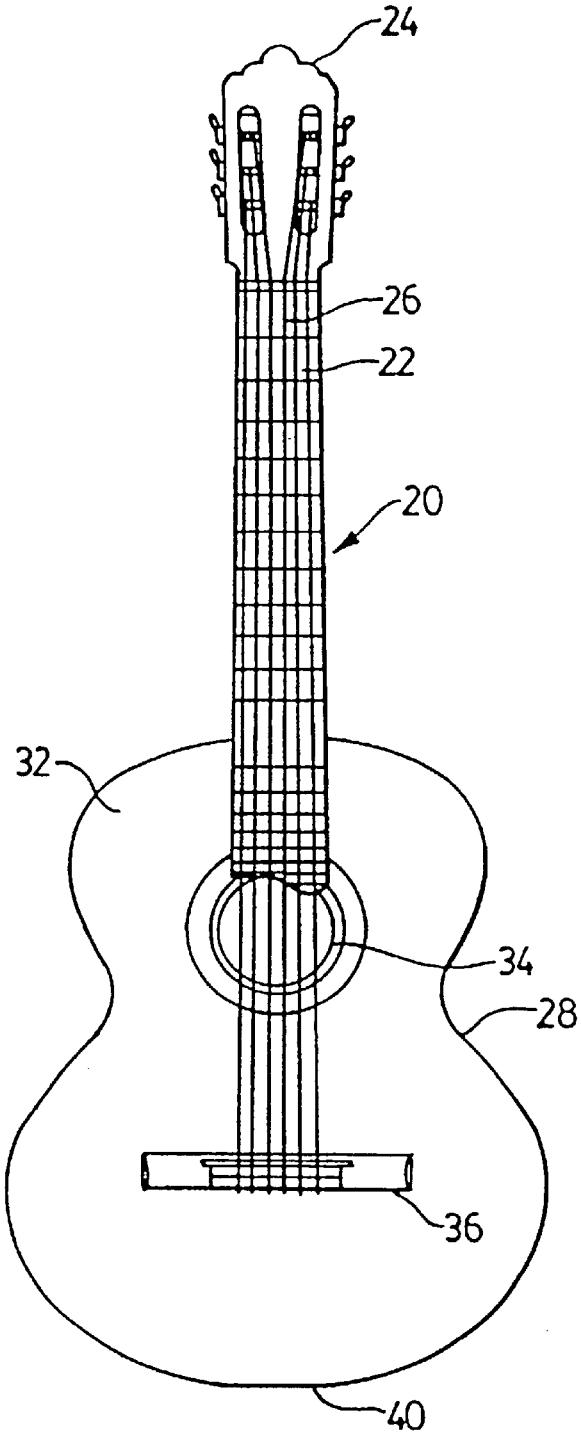
FIG. 1 (PRIOR ART)
FIG. 1, in a front view, illustrates a guitar according to the prior art.
Figure 2:
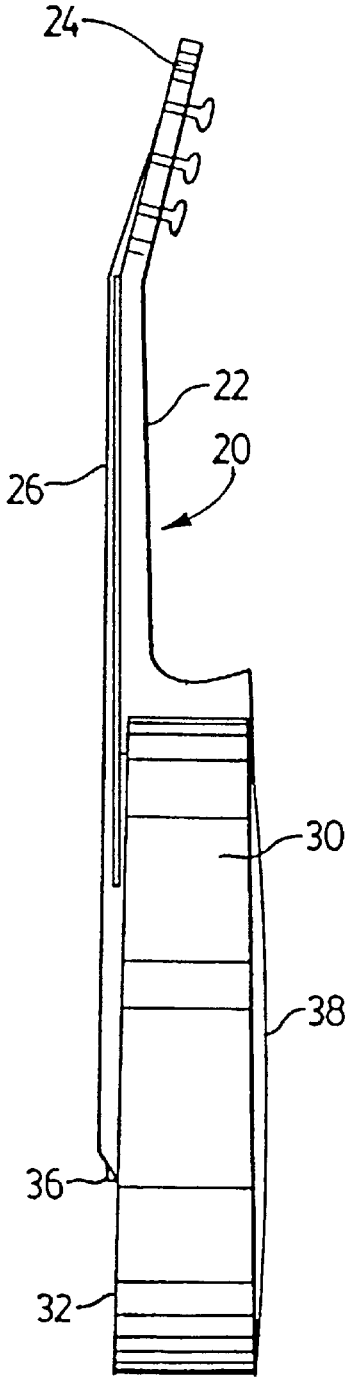
FIG. 2 (PRIOR ART)
FIG. 2 is a side view of the guitar of FIG. 1.

Referring to FIG. 1, there is illustrated in a front view, a guitar 20 in accordance with the prior art. The guitar 20 includes a head 24 that is connected to a soundbox 28 by a neck 22. The soundbox 28 includes a sound hole 34 in a soundboard 32. Strings 26 extend from the head 24 of the guitar 20 along the neck 22 across the sound hole 34 and partly along the soundboard 32 to a bridge 36 attached to the soundboard 32. Referring to FIG. 2, the guitar of FIG. 1 is shown in a side view. As shown in FIG. 2, the guitar 20 further includes a back 38 and a side 30 of the soundbox 28.

The tone of the guitar 20 depends mainly on the vibration of the soundboard 32, although the side 30 and the back 38 also help to determine the tone. Generally speaking, the more freely the soundboard 32 is able to vibrate, the better the tone of the guitar 20. The soundboard 32 acts analogously to a speaker in a stereo—the more the soundboard 32 moves, the louder and better the tone. Typically, the soundboard 32, back 38 and side 30 are made of wood; however, these components may also be made of graphite or other suitable material.

The guitar 20 must also, however, be strong enough to resist the compressive force provided by the tension in the string 26. While the neck 22 and head 24 are typically well able to withstand the compressive stress exerted by the tension in the strings 26, it may be otherwise with the soundboard 32. Precisely because the soundboard 32 should be able to vibrate as freely as possible, the soundboard 32 must be quite thin. However, a thin soundboard is likely to buckle as a consequence of the compressive stress exerted on the soundboard by the tension in the strings 26.

Figure 3:
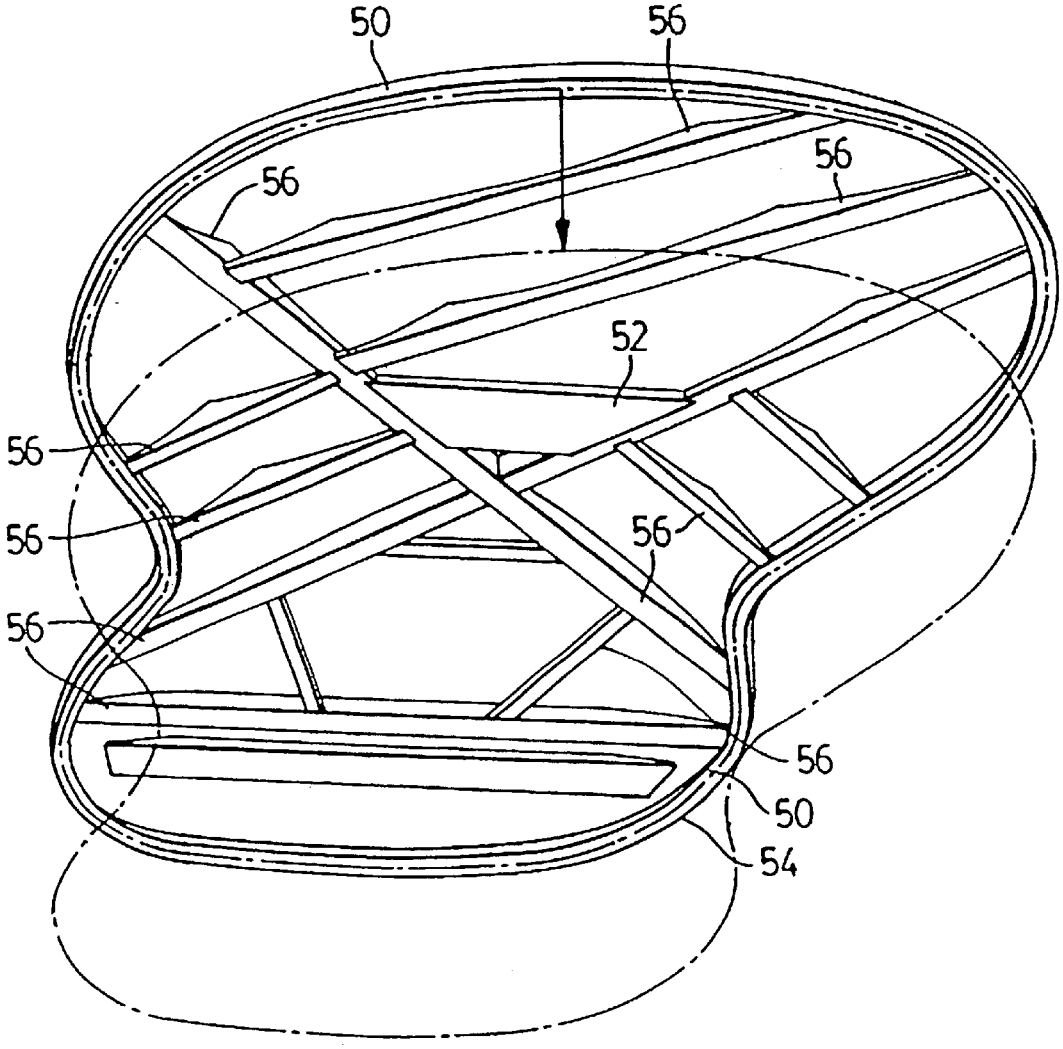
FIG. 3 (PRIOR ART)
FIG. 3, in an exploded perspective view, illustrates the soundboard support structure under the soundboard of the guitar of FIG. 1.

In order to address this problem traditional guitars have relied on a soundboard and back support structure. A support structure according to the prior art is shown in the exploded perspective views of FIGS. 3, 4 and 5. FIG. 3, in an exploded perspective view, illustrates soundboard braces that extend across the soundboard 32, inside the soundbox 38, of the guitar 20 in order to strengthen the soundboard 32. The outline of the soundboard 32, shown in dotted line, has been exploded up from the bracing, leaving a dotted line to mark its original position around kerfing 50.

The kerfing 50 increases the gluing surface available to attach the soundboard 32 to the side 30. This is necessary as the thickness of the soundboard 32, back 38 and the side 30 is typically only about ⅛ of an inch—not enough to securely attach two pieces of wood at a right angle. The kerfing 50, is about ½ inch in height, and about ¼ inch wide, and is attached to the side 30 and soundboard 32 at their juncture, as well as to the side 30 and back 38 at their juncture, in order to increase the available gluing space. The bridge 36 of the guitar 120 requires additional reinforcement due to the tension in the strings 26. Accordingly, the soundboard 32 is reinforced underneath the bridge 36 by a bridge plate 52.

Figure 4:
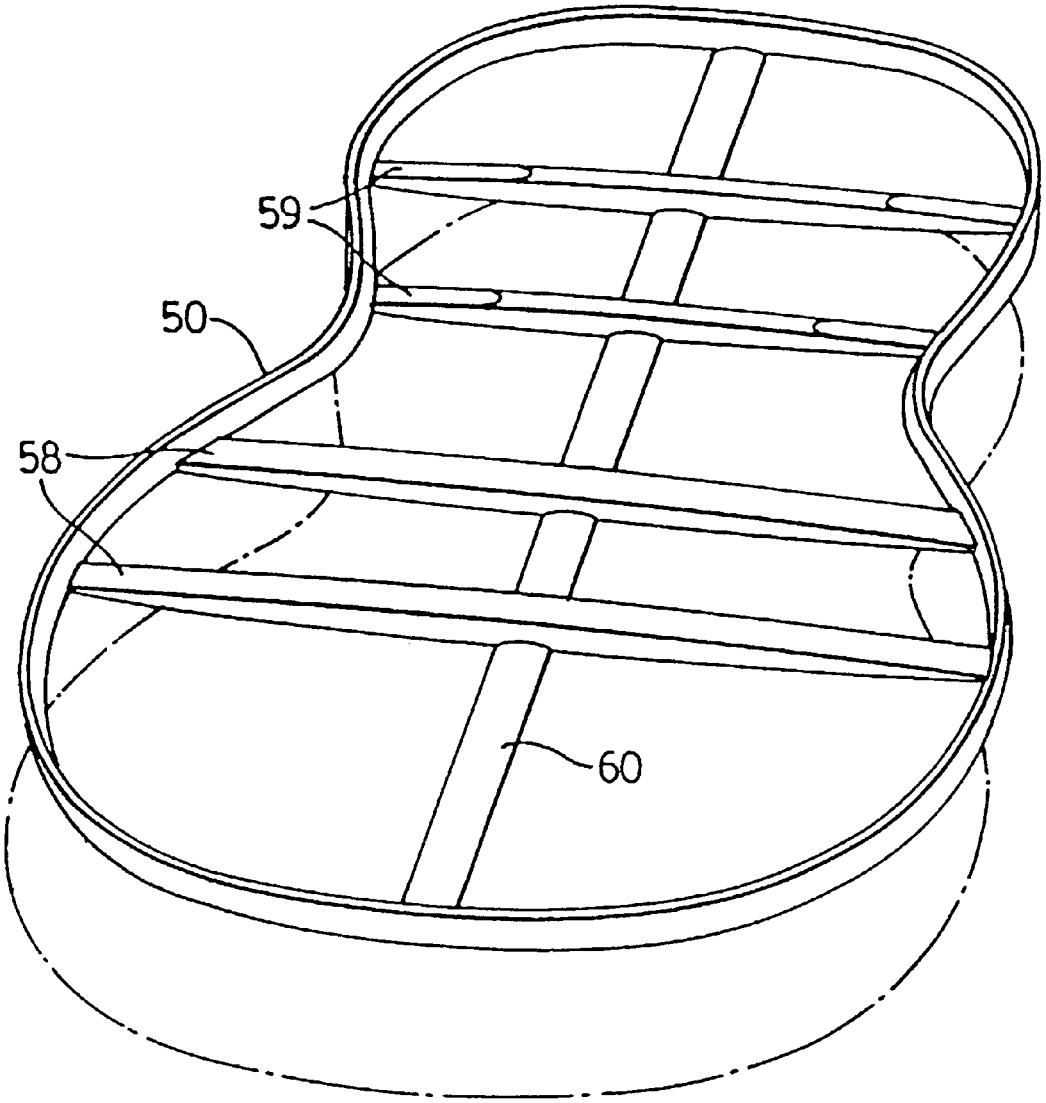
FIG. 4 (PRIOR ART)
FIG. 4, in an exploded perspective view, illustrates the back support structure under the back of the guitar of FIG. 1.

FIG. 4 in an exploded perspective view, illustrates back braces 58 that extend laterally across the back 38 of the guitar and back strips 60 that extend longitudinally along the back 38 of the guitar in order to strengthen the back 38. The outline of the back 38, shown in dotted line, has been exploded up from the bracing, leaving a dotted line to mark its original position around kerfing 50.

Soundboard 32 is typically made of a different species of wood then side 30 (back 38 may also be made of a different species of wood then side 30). This difference arises from the different primary functions that the soundboard 32 and the side 30 perform. Specifically, soundboard 32 must be able to vibrate in order to satisfy its acoustic function, while side 30 must be relatively rigid in order to perform its structural function. Accordingly, there will be a transition between these two species of wood where the side 30 meets the soundboard 32. At this juncture, a channel is routed into the side 30 and soundboard 32. Then, several binding pieces 54 are typically inserted into the channels where the side 30 meets the soundboard 32 in order to mask this transition. If the back 38 is also made of a different species of wood from the side 30, then a channel may be similarly routed into the side 30 and the back 38 at their juncture, and several binding pieces 54 inserted in order to mask this transition.

As of these parts of the support structure are individually machined and installed during the manufacture of the guitar. Specifically, kerfing 50 which is typically made up to 12 pieces, is glued around the circumference of the side 30 in order to secure the soundboard 32 and back 38 to the side 30. Once the soundboard 32 and back 38 are attached to the side 30, there is a noticeable seam where the two pieces of wood—usually of different species—meet. In order to cover the seam to make the instrument more cosmetically pleasing, a channel is routed into the soundboard 32 and side 30 where they meet, as well as where the back 38 and side 30 meet. Then, plastic binding 54 is glued into the channel in order to cover up the seam.

This support structure typically requires 36 or more pieces including 12 pieces of cedar kerfing (this number may vary depending of the length of each piece of kerfing), up to 13 spruce soundboard braces 56, up to four space back braces 58, up to four back strip components 60, up to four pieces of plastic binding 54 and a bridge plate 52. To assemble all of these pieces into a guitar will require skilled labour and will take a considerable amount of time.

Figure 5:
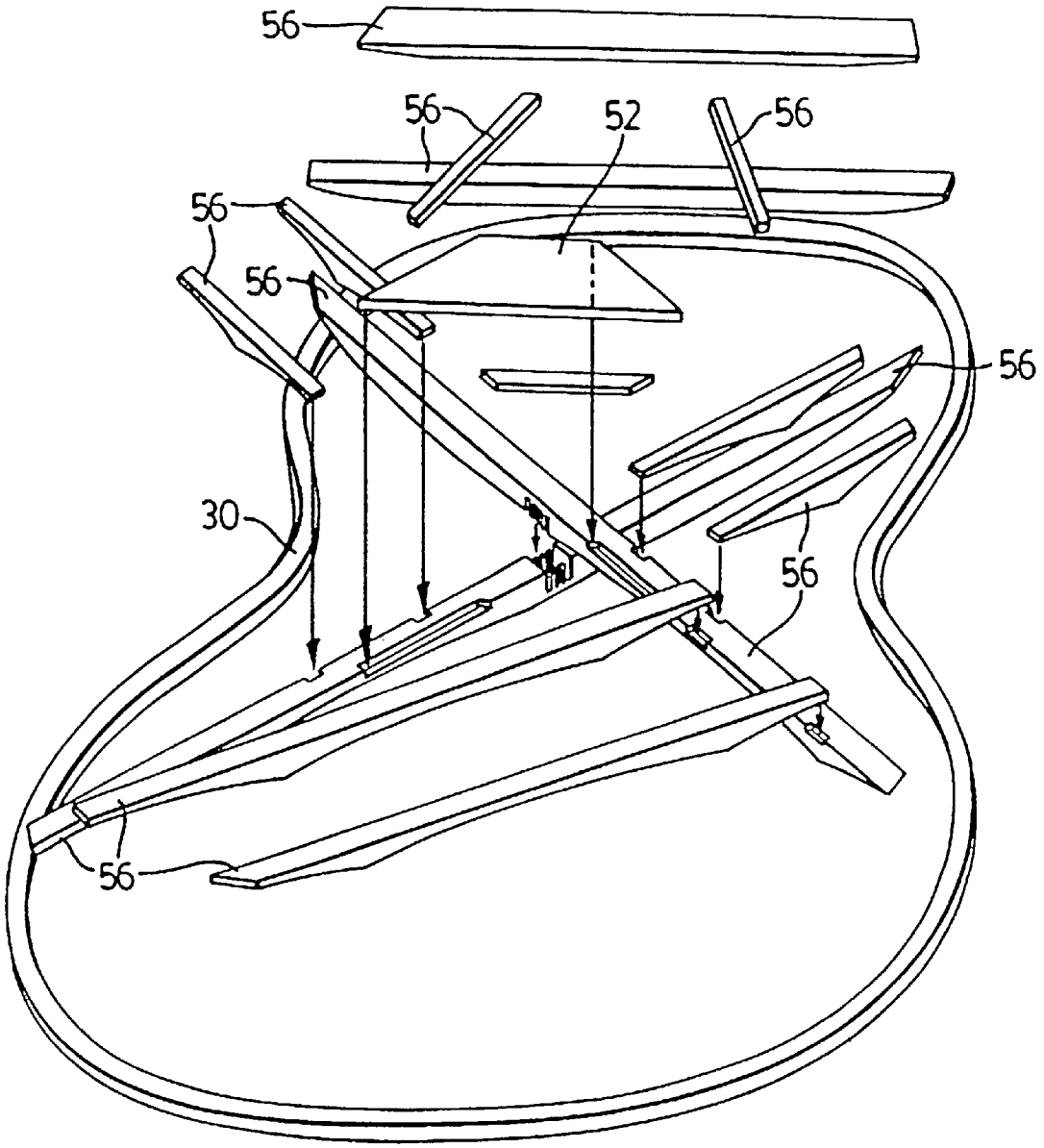
FIG. 5 (PRIOR ART)
FIG. 5, in a disassembled exploded perspective view, illustrates the soundboard support structure of FIG. 3.

Referring to FIG. 5, there is illustrated in an exploded perspective view, illustrates the soundboard braces 56 prior to assembly. The soundboard braces are formed to have recesses that engages the recesses in other soundboard braces 56 to secure the braces 56 together.

Figure 6:
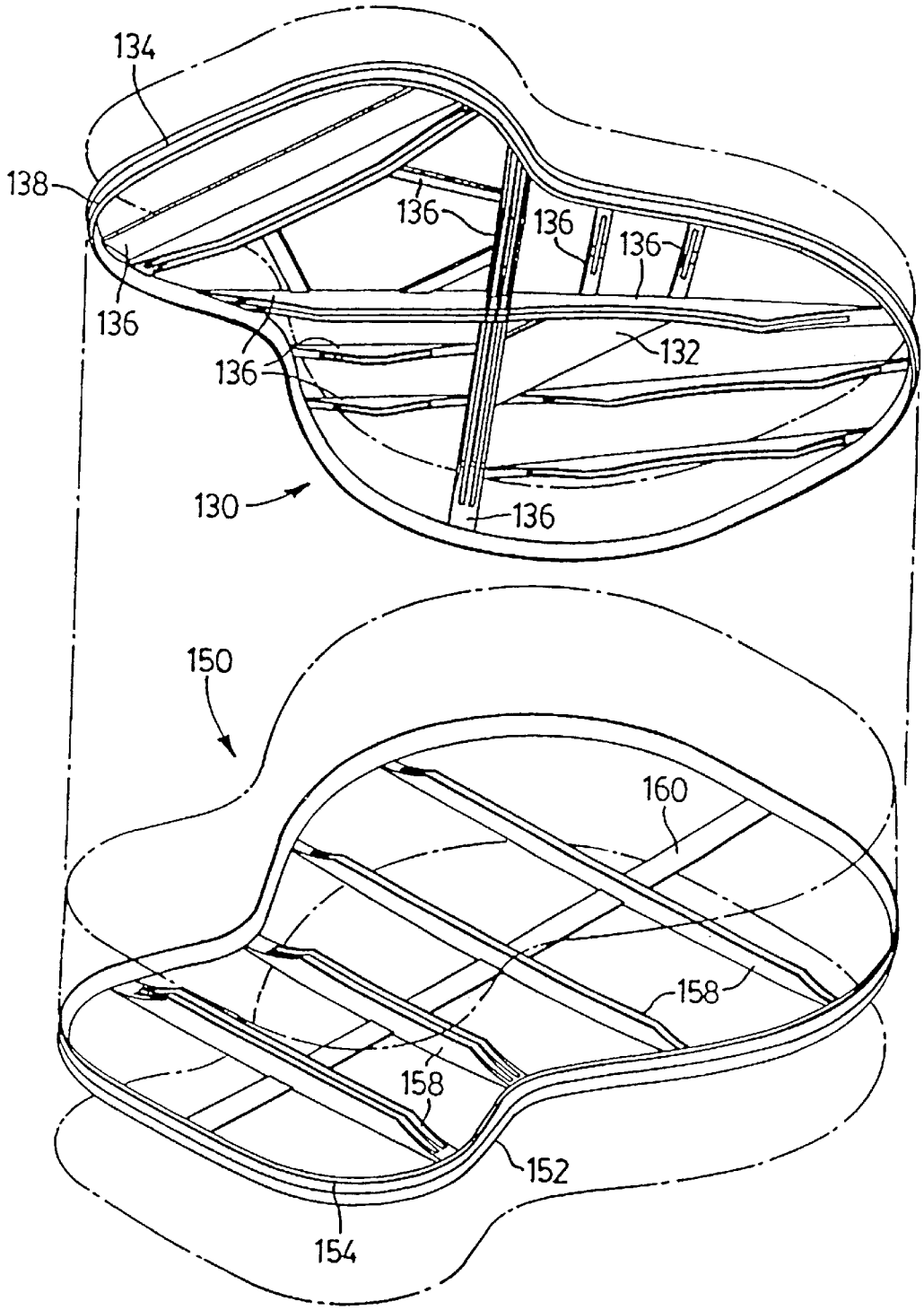
FIG. 6, in an exploded clam shell view, illustrates an acoustic support structure according to a preferred embodiment of the present invention.

Referring to FIG. 6, there is illustrated in an exploded clam shell view, an acoustic support structure according to a preferred embodiment of the present invention. The acoustic support structure comprises a soundboard support structure 130 and a back support structure 150. The soundboard outline is shown in dotted lines and is exploded upwards from the soundboard support structure 130. The outline of the back is also shown in dotted lines and is exploded downward from the back support structure 150. The sides of a soundbox of a guitar embodying the invention are shown in dotted outline extending upwardly from the back support structure 150.

The back support structure 150 of FIG. 6 includes a back binding portion 152, a back kerfing portion 154, a back bracing portion 158 and a back strip portion 160. The entire back support structure 150 is formed from plastic as a single piece which is glued to the side of the guitar within the hollow interior to reinforce the back of the guitar.

The soundboard support structure 130 of FIG. 6 includes a soundboard kerfing portion 138, a bridge plate portion 132, a soundboard binding portion 134, and a soundboard bracing portion 136. However, all of these portions are formed from plastic as a single piece. The soundboard kerfing portion 138 provides an extended gluing surface for fastening the soundboard to the sides of the soundbox of the guitar. The bridge plate portion 132 reinforces the bridge of the guitar. The soundboard binding portion 134 masks the seam where the soundboard meets the sides of the guitar and the soundboard bracing portion 136 reinforces the soundboard of the guitar.

As the soundboard must be free to vibrate, but must also be sufficiently reinforced by the soundboard support structure 130 to resist the compressive stress of the strings, the material that the soundboard support structure 130 is made of must be carefully selected. Specifically, as soundboard bracing components have traditionally been made of spruce, the plastic material selected should preferably be similar to spruce, at least in terms of its acoustic properties, in order to mimic guitars made in the traditional way. Important features in selecting the plastic include the following:

1. The ratio of the plastic's modulus of elasticity to its density should resemble that of spruce.
2. The plastic should provide good adhesion using glue.
3. The plastic should be aesthetically attractive, as well as lightweight and is resistant.
4. The plastic should be injection moldable.
5. The plastic should have a low coefficient of thermal expansion.
6. The plastic, should, other things being equal, be inexpensive.
7. The plastic should have a tangent delta value of approximately 0.0256 at a frequency of 100 hertz—approximately the tangent delta value of spruce.

Preferably, the acoustic support structure is made from a thermoplastic polymer such as thermoplastic polyurethane containing half inch glass fibers, which suitably mimics the acoustic properties of spruce, while also being comparatively inexpensive.

Figure 7:
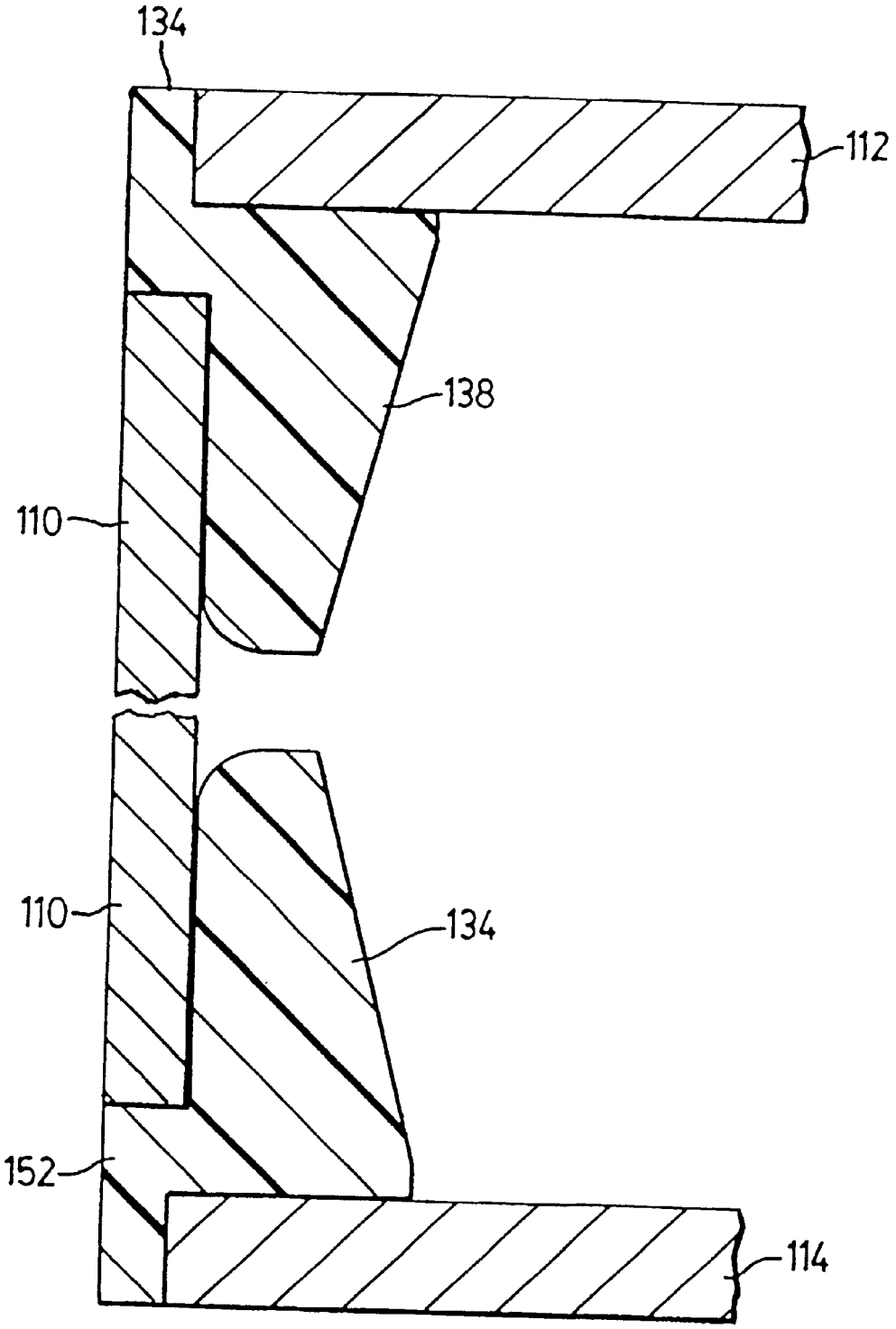
FIG. 7, in an enlarged sectional view, illustrates a side of a soundbox of a guitar incorporating an acoustic support structure in accordance with the present invention.

FIG. 7, in a sectional view, illustrates the side of a soundbox of a guitar incorporating the acoustic support structure of FIG. 6. The side is shown at its junctures with both the soundboard and the back of the guitar. Specifically, a soundboard 112 and a side 110 are secured to each other by the soundboard kerfing portion 138 and a soundboard binding portion 134 of the soundboard support structure 130. Similarly, the side 110 and a back 114 of the guitar are joined by the back kerfing portion 154 and the back binding portion 152 of the back support structure 150.

Using the acoustic support structure of the present invention, a guitar can be assembled in a fraction of the time required to assemble conventional guitars. Further, the resulting guitar will not differ substantially either in appearance or acoustic properties from guitars manufactured in accordance with conventional techniques. Using the acoustic support structure of the present invention also reduces the skill level required of the workers in assembling the guitar.

Prior to assembly, the soundboard support structure 130 and the back support structure are formed by injection molding. The side portions, soundboard and back portions of the guitar are then cut for assembly. Unlike conventional guitar manufacture, where the support structure can be modified slightly to accommodate discrepancies in the dimensions of the soundboard, side portions and back portions of a guitar, in the assembly of a guitar according to the present invention, the soundboard, side portions and back portions should be cut to substantially the same measurement as the acoustic support structure.

Figure 8:
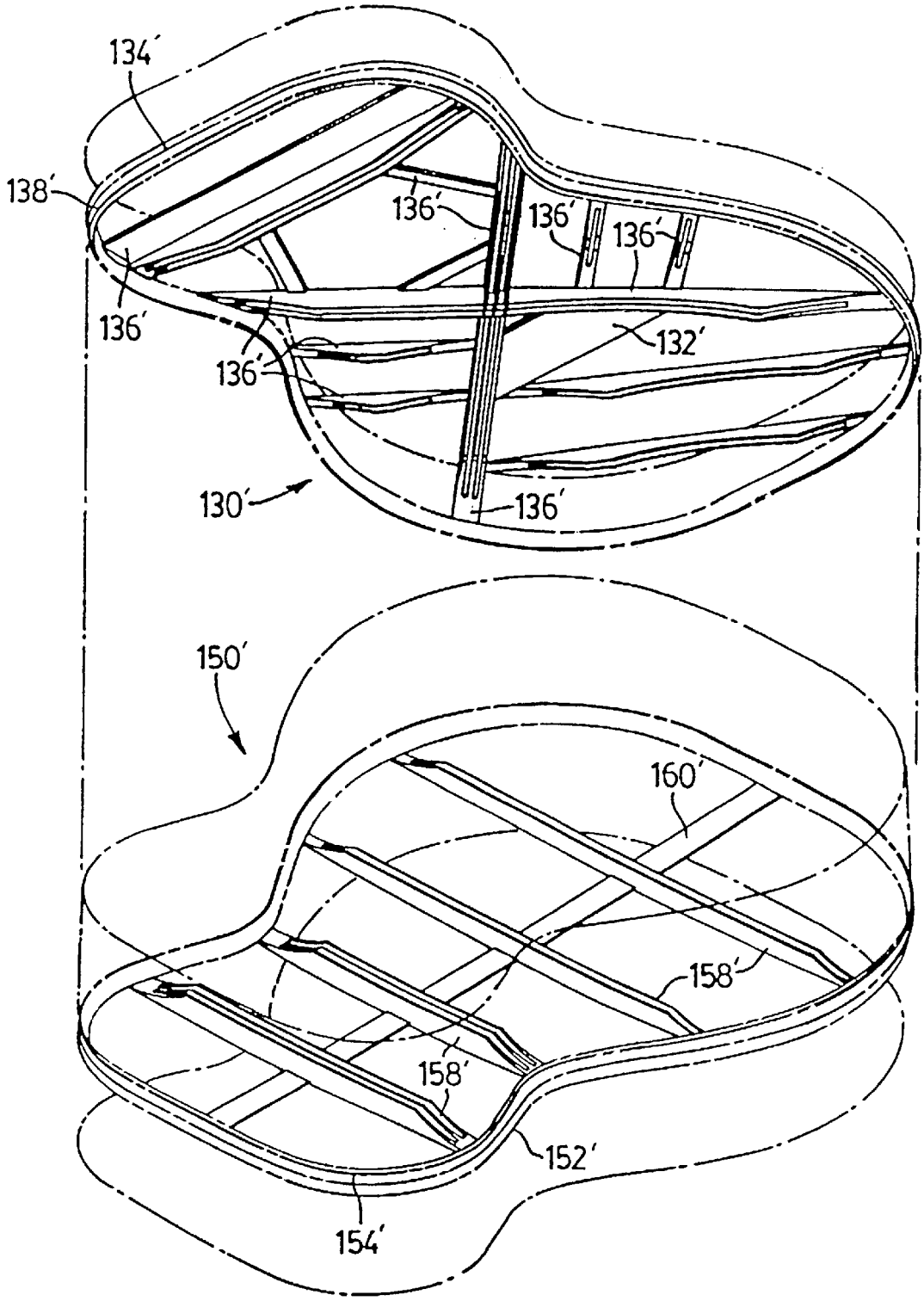
FIG. 8, in an exploded clam shell view, illustrates an acoustic support structure according to a second preferred embodiment of the present invention; and, FIG. 9, in an exploded clam shell view, illustrates an acoustic support structure according to a third preferred embodiment of the present invention.

Referring to FIG. 8, there is illustrated in an exploded clam shell view, an acoustic support structure according to a second preferred embodiment of the invention. The acoustic support structure comprises a soundboard support structure 130' and a back support structure 150'. The soundboard outline is shown in dotted lines and is exploded upwards from the soundboard support structure 130'. The outline of the back is also shown in dotted lines and is exploded downwards from the back support structure 150'. The sides of a soundbox of a guitar embodying the invention are shown in dotted outline extending upwardly from the back support structure 150'.

The soundboard support structure 130' of FIG. 8 includes a soundboard bracing portion 136' and a bridge plate portion 132', but does not include a kerfing portion or binding portion. Instead, the guitar includes a kerfing portion 50' and a binding portion 54'. The soundboard bracing portion 136' and bridge plate portion 132' are formed from plastic as a single piece which is glued to the kerfing portion 50' underneath the soundboard to reinforce the soundboard.

The back support structure 150' of FIG. 8 includes a back bracing portion 158' and a back strip portion 160', but does not include a kerfing portion or binding portion. The back bracing portion 158' and back strip portion 160' are formed from plastic as a single piece which is glued to the kerfing portion 50' underneath the back to reinforce the back.

Figure 9:
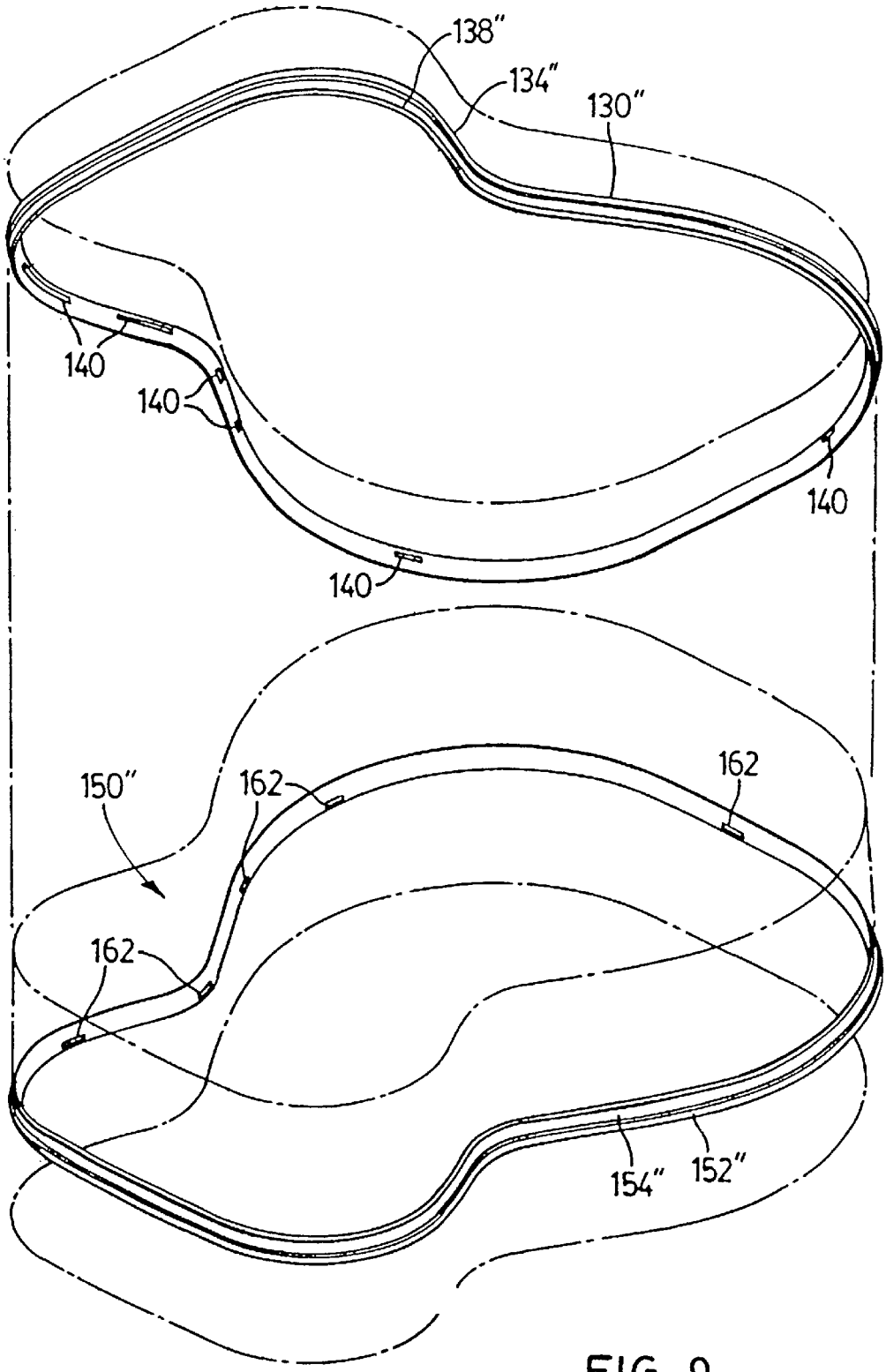

Referring to FIG. 9, there is illustrated in an exploded clam shell view, an acoustic support structure according to a third preferred embodiment of the invention. The acoustic support structure comprises a soundboard support structure 130" and a back support structure 150". The soundboard outline is shown in dotted lines and is exploded upwards from the soundboard support structure 130". The outline of the back is also shown in dotted lines and is exploded downwards from the back support structure 150". The sides of a soundbox of a guitar embodying the invention are shown in dotted outline extending upwardly from the back support structure 150".

The soundboard support structure 130" of FIG. 9 includes a soundboard kerfing portion 138" and a soundboard binding portion 134", but does not include a soundboard bracing portion or a bridge plate portion. The soundboard kerfing portion 138" and soundboard binding portion 134" are formed from plastic as a single piece which is glued to the side of the guitar underneath the soundboard to reinforce the soundboard. The soundboard kerfing portion 138" includes recesses 160 spaced to receive the ends of soundboard braces that stretch across the soundbox underneath the soundboard.

The back support structure 150" of FIG. 9 includes a back kerfing portion 154" and a back binding portion 152", but does not include a back bracing portion or a bridge plate portion. The back kerfing portion 154" and back binding portion 152" are formed from plastic as a single piece which is glued to the side of the guitar underneath the back to reinforce the back. The back kerfing portion 154" includes recesses 160 spaced to receive the ends of back braces that stretch across the soundbox underneath the back.

Other variations and modifications are possible. In particular, while an acoustic support structure for a guitar has been described above, such an acoustic support structure could readily be modified for incorporation in other wooden musical instruments. Accordingly, all such modifications or variations are believed to be within the scope of the invention as defined by the claims appended hereto.

What is claimed is:

1. A stringed musical instrument comprising a soundbox, the soundbox having a back, a side adjoining the back to define a hollow interior, a soundboard covering the hollow interior, and a soundboard support structure including a plurality of kerfing members for securing the soundboard on the side opposite the back to cover the hollow interior and a plurality of bracing members for reinforcing the soundboard, wherein the soundboard support structure includes a plurality of adjoining members selected from the group consisting of the plurality of kerfing members and the plurality of bracing members, the plurality of adjoining members being integrally formed as a single piece of a hardenable plastic material.

2. The musical instrument as defined in claim 1 wherein the hardenable plastic material is a thermoplastic polymer.

3. The musical instrument as defined in claim 2 wherein the thermoplastic polymer is polyurethane containing a plurality of half-inch glass fibers.

4. The musical instrument as defined in claim 3 wherein the plurality of adjoining members includes the plurality of kerfing members; and, a binding means for covering a seam where the side adjoins the soundboard.

5. The musical instrument as defined in claim 4 wherein the plurality of bracing members comprises a plurality of separate braces, the plurality of separate braces being disposed within the hollow interior, and the plurality of kerfing member includes a plurality of spaced recesses for receiving the plurality of separate braces.

6. The musical instrument as defined in claim 2 wherein the plurality of adjoining members includes the plurality of bracing members.

7. The musical instrument as defined in claim 6 wherein the plurality of bracing members includes a bridge plate member for reinforcing the soundboard underneath a bridge for securing a plurality of strings to the soundboard.

8. The musical instrument as defined in claim 2 further comprising a back kerfing portion for joining the side and the back, the back kerfing portion having a plurality of back kerfing members; and a plurality of back-bracing members for reinforcing the back;

wherein a second plurality of adjoining members selected from the back kerfing members and the adjoining of back-bracing members are integrally formed as a second single piece of the hardenable plastic material.

9. The musical instrument as defined in claim 8 wherein the hardenable plastic material is a thermoplastic polymer.

10. The musical instrument as defined in claim 1 wherein the back is made of one of wood and graphite;

the side is made of one of wood and graphite; and, and soundboard is made of one of wood and graphite.

11. A method of manufacturing a stringed musical instrument having a soundbox, the soundbox having a back, a side adjoining the back to define a hollow interior, and a soundboard covering the hollow interior, the method comprising:

forming a soundboard support structure for supporting the soundboard on the soundbox, the soundboard support structure including a plurality of kerfing members for securing the soundboard on the side opposite the back to cover the hollow interior, a plurality of bracing members for reinforcing the soundboard, and a plurality of adjoining members selected from the group consisting of the plurality of kerfing members and the plurality of bracing members, the plurality of adjoining members being formed as a single piece of a hardenable plastic material; shaping the back, side and soundboard of the soundboard to substantially conform to the dimension of the single piece of the hardenable plastic material;

securing the soundboard on the side using the soundboard support structure; and securing the back on the side opposite the soundboard.

12. The method as defined in claim 11 wherein the hardenable plastic material is a thermoplastic polymer.

13. The method as defined in claim 12 wherein the thermoplastic polymer is polyurethane containing a plurality of half-inch glass fibers.

14. The method as defined in claim 13 wherein the plurality of adjoining members is formed as the single piece by injection molding.

15. The method as defined in claim 14 wherein the plurality of adjoining members comprises the plurality of kerfing members; and, a binding means for covering a seam where the side adjoins the soundboard.

16. The method as defined in claim 13 wherein the plurality of kerfing members is formed to have a plurality of spaced recesses for receiving a plurality of braces, and the method further comprises fitting a plurality of braces into the recesses within the hollow interior to reinforce the soundboard.

17. The method as defined in claim 14 wherein the plurality of adjoining members includes the plurality of braces.

18. The method as defined in claim 14 further comprising the step of forming a back support structure for securing the back on the side, the back support structure including a plurality of back kerfing members for securing the back on the side, a plurality of back bracing members for reinforcing the back, and a second plurality of adjoining members selected from the group consisting of the plurality of back kerfing members and the plurality of back bracing members, the second plurality of adjoining members being formed as a second single piece of the hardenable plastic material.

* * * * *